US006308537B1

(12) United States Patent
Lin

(10) Patent No.: US 6,308,537 B1
(45) Date of Patent: Oct. 30, 2001

(54) NOZZLE FOR KNITTING MACHINE

(76) Inventor: Sue-Ping Lin, 8F-2, No. 188, Ta Tung Rd., San Hsia Town, Taipei Hsien (TW)

( * ) Notice: Subject to any disclaimer, the term of this patent is extended or adjusted under 35 U.S.C. 154(b) by 0 days.

(21) Appl. No.: 09/836,247

(22) Filed: Apr. 18, 2001

(51) Int. Cl.[7] ..... D04B 15/48

(52) U.S. Cl. ..... 66/125 A; 28/271; 66/125 R; 66/1 R

(58) Field of Search ..... 28/271, 272, 274, 28/275, 276, 273, 254; 57/289, 333, 350, 908; 66/1 R, 9 R, 125 R, 134, 135, 140 S, 145 S, 146, 125 A, 168

(56) References Cited

U.S. PATENT DOCUMENTS

| | | | | |
|---|---|---|---|---|
| 4,335,588 | * | 6/1982 | Bos | 66/125 A |
| 4,547,938 | * | 10/1985 | Cullen et al. | 28/272 |
| 4,769,880 | * | 9/1988 | Heinrich et al. | 66/125 A |
| 5,839,176 | * | 11/1998 | Lin | 28/271 |
| 6,163,944 | * | 12/2000 | Lin | 28/274 |

* cited by examiner

*Primary Examiner*—Danny Worrell
(74) *Attorney, Agent, or Firm*—Bacon & Thomas, PLLC

(57) ABSTRACT

A nozzle for knitting machine comprises a fastening block comprising a U-shaped opening and an inlet hole; a seat under the fastening block adjacent the U-shaped opening, the seat comprising an opening in communication with the U-shaped opening; a trigger member pivotably disposed on both sides of the fastening block, the trigger member comprising a raised member in the opening of the seat; and a sliding block removably received in the U-shaped opening, the sliding block comprising a riser facing the seat, an inlet channel through the sliding block, a block member on the top of the inlet channel, a V-shaped groove on the block member, an aperture extended downwardly from the V-shaped groove being in communication with the inlet channel and the inlet hole. In blowing operation, yarn is placed on the V-shaped groove. Then move the sliding block toward the seat with the riser of the sliding block inserted into the opening of the seat. Next pivot the trigger member to cause the raised member of the trigger member to be disposed vertically. Thus, the sliding block is confined in a U-shaped opening. Hence, external high pressure air is directed to blow onto yarn. The yarn blowing or cleaning operation is made convenient. Further, the components are simplified. Thus, assembly is simple and manufacturing cost is reduced.

5 Claims, 4 Drawing Sheets

NOZZLE FOR KNITTING MACHINE

FIELD OF THE INVENTION

The present invention relates to nozzles and more particularly to a nozzle for knitting machine with improved characteristics.

BACKGROUND OF THE INVENTION

A conventional nozzle mounted in a knitting machine is shown in FIG. 4 comprising a U-shaped fastening block 1 comprising a top 11, a bottom 12, an inlet hole 14 through the bottom 12 in communication with an external air compressor, a bore 16 through top 11 aligned with inlet hole 14, a stop member 65, an abutment member 61, a sleeve 6, a screw 62, a spring 63, and an adjusting cap 64 wherein elements 65, 61, 6, 62, 63 and 64 are provided in bore 16 from bottom to top; a female fastening member 2 on the vertical side of U-shaped fastening block 1; a sliding block 3 on the open side of U-shaped fastening block 1 and comprising a through inlet channel 31 in communication with inlet hole 14; a male fastening member 4 extended from side of sliding block 3 corresponding to female fastening member 2; and a block member 5 on the top of sliding block 3 and having a V-shaped groove 51 and an aperture 52 on the V-shaped groove 51 being in communication with inlet hole 14 and inlet channel 31.

In blowing operation, yarn is first placed on V-shaped groove 51. Then engage male fastening member 4 and female fastening member 2 to mount sliding block 3 in U-shaped fastening block 1 wherein inlet hole 14, inlet channel 31, and aperture 52 are in communication one another. External high pressure air is directed to blow yarn through inlet hole 14. As to the cleaning of block member 5, it is simply required to disengage male fastening member 4 from female fastening member 2 prior to removing sliding block 3 from U-shaped fastening block 1. However, the previous design suffered from several disadvantages. For example, the elements provided in bore 16 are complicated. Further, arms 42 of male fastening member 4 tends to break or malfunction after a long time of use (i.e., engaging with female fastening member 2 by pressing the arms 42). Furthermore, the assembly is complex and the manufacturing cost is relatively high.

SUMMARY OF THE INVENTION

It is thus an object of the present invention to provide a nozzle for knitting machine. In blowing operation, yarn is first placed on a V-shaped groove. Then move a sliding block toward a seat with a riser of the sliding block inserted into an opening of the seat. Next pivot a trigger member to cause a raised member of a n-shaped trigger member to be disposed vertically. Thus, the sliding block is confined in a U-shaped opening of a fastening block. Hence, external high pressure air is directed to blow onto yarn. The yarn blowing or cleaning operation according to the present invention is made much convenient as compared with prior art. Further, the constituent components are simplified. Thus, assembly is simple and manufacturing cost is reduced.

The above and other objects, features and advantages of the present invention will become apparent from the following detailed description taken with the accompanying drawings.

DETAILED DESCRIPTION OF THE PREFERRED EMBODIMENTS

Figure 1:
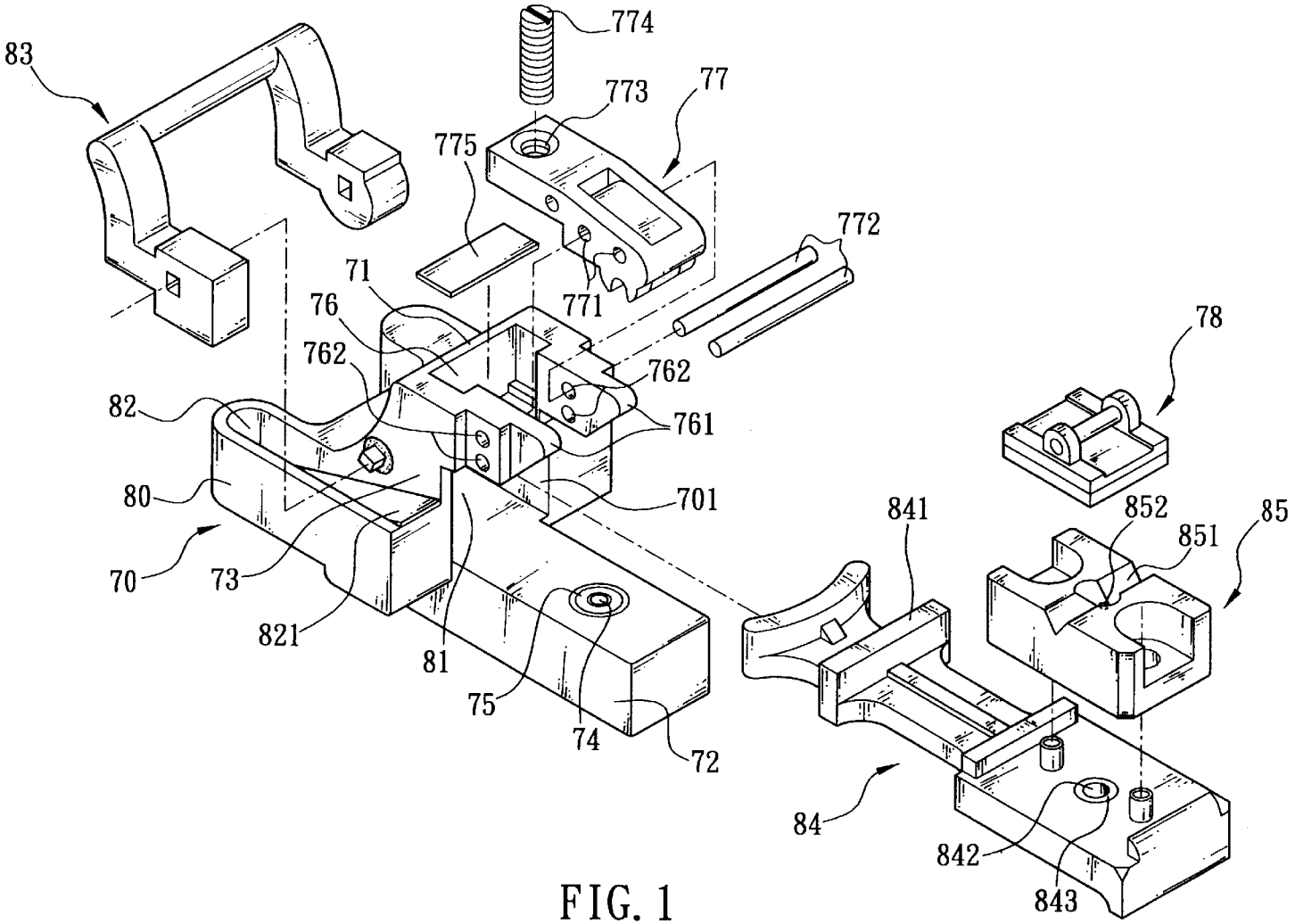
FIG. 1 is an exploded view of a nozzle for knitting machine according to the invention.
Figure 2:
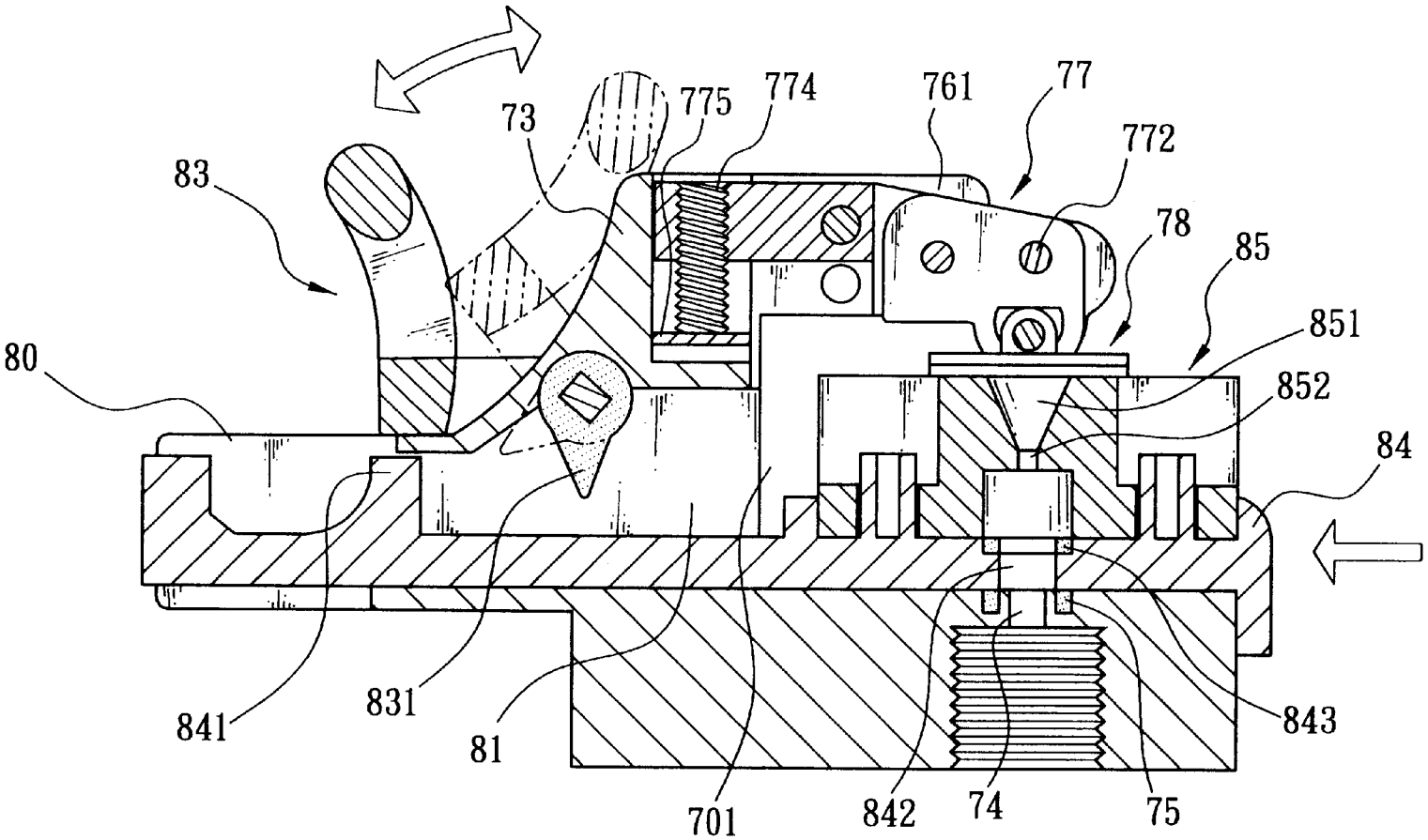
FIG. 2 is a sectional view of FIG. 1 for illustrating an operation of the nozzle.
Figure 3:
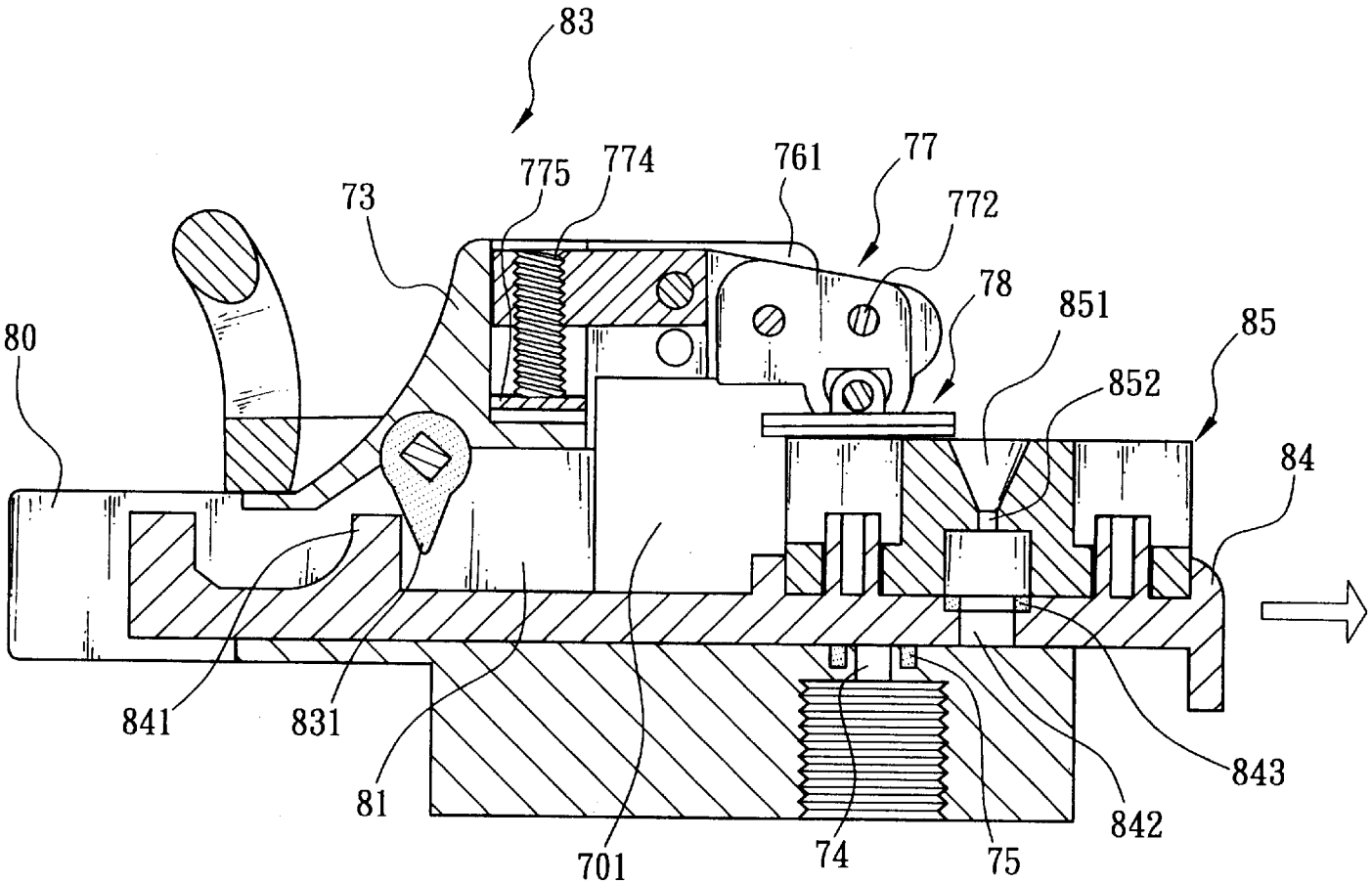
FIG. 3 is a sectional view of FIG. 1 for illustrating a reverse operation of the nozzle.
Figure 4:
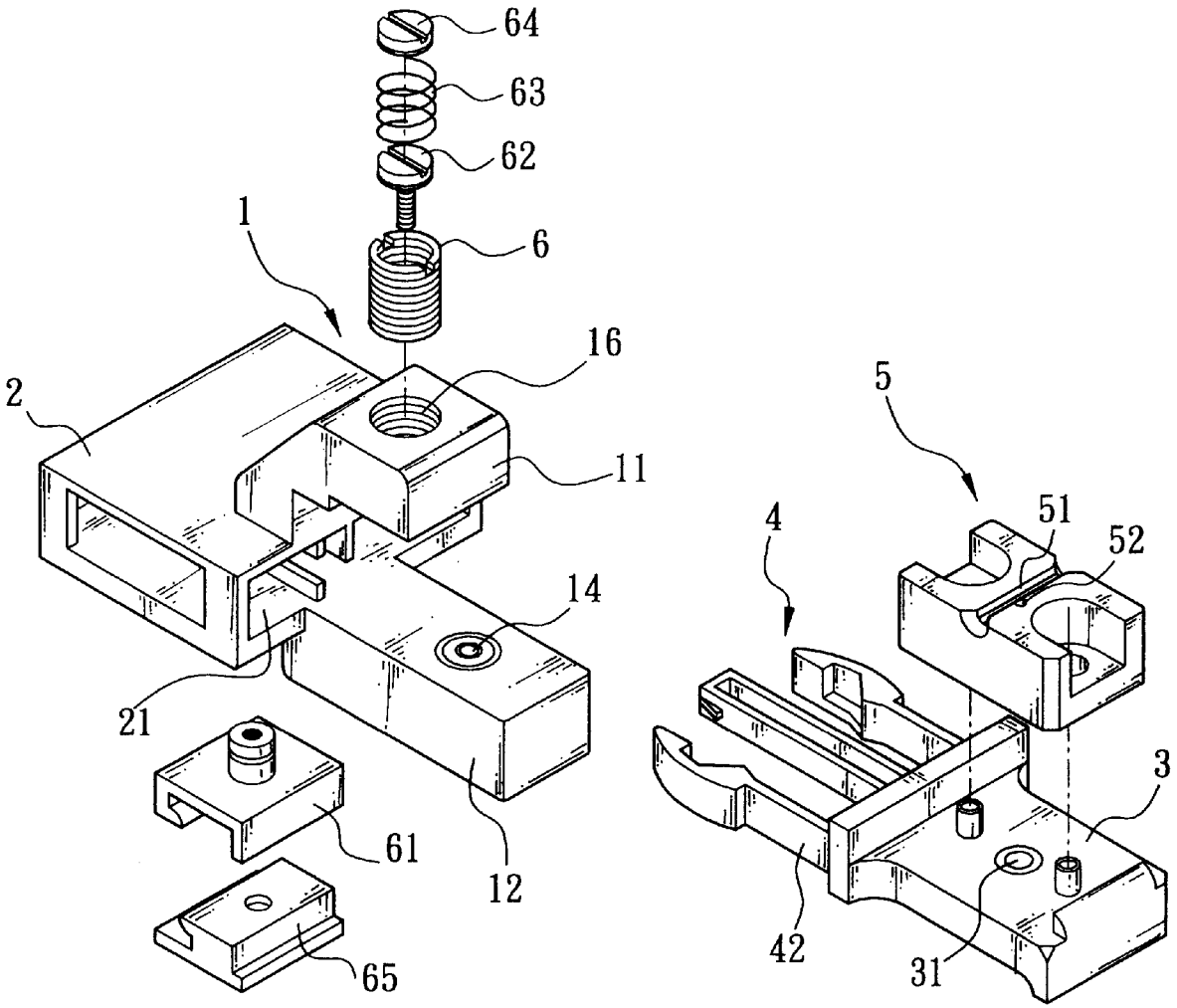
FIG. 4 (Prior Art)
FIG. 4 is an exploded view of a conventional nozzle for knitting machine.

Referring to FIGS. 1 to 3, there is shown a nozzle for knitting machine constructed in accordance with the invention comprising a fastening block 70 comprising a U-shaped opening 701, a top 71, a bottom 72, a vertical section 73 coupled between top 71 and bottom 72, an inlet hole 74 through the bottom 72 in fluid communication with an external air compressor, a washer 75 rested on inlet hole 74 for maintaining air-tightness, a recess 76 on the same side as inlet hole 74 formed on top 71, a pair of arms 761 on both sides of recess 76, a plurality of holes 762 (two are shown) on each arm 761, an engagement member 77 between arms 761, a plurality of transverse holes 771 (two are shown) through the engagement member 77 aligned with holes 762, a pair of locking pins 772 inserted through holes 762 on one side, holes 771, and holes 762 on the other side for fastening engagement member 77 in recess 76, a stop member 78 under engagement member 77 but above inlet hole 74, a longitudinal hole 773 through engagement member 77 in communication with recess 76, an adjusting screw 774 threadedly secured in hole 773, and an elastic plate 775 in the recess urged against the bottom of adjusting screw 774 for adjusting the position of stop member 78. The bottom of stop member 78 is formed of ceramic material. The nozzle further comprises a seat 80 at the end adjacent to the vertical section 73, but opposite to the bottom 72 of fastening block 70. Seat 80 comprises an opening 81 in communication with U-shaped opening 701, a groove 82 on top, an elastic plate 821 obliquely disposed in groove 82, a n-shaped trigger member 83 pivotably disposed on both sides of vertical section 73, a raised member 831 in opening 81 (FIGS. 2 and 3) capable of being disposed horizontally or vertically when pivoting the trigger member 83, one side of trigger member 83 capable of fastening to elastic plate 821 in groove 82, a sliding block 84 removably received in the opening 701 and comprising a riser 841 at the end corresponding to the seat 80, an inlet channel 842 through sliding block 84 in communication with inlet hole 74, a washer 843 rested on inlet channel 842, a block member 85 formed of ceramic material disposed on the top of inlet channel 842 and having a V-shaped groove 851 and a funnel-shaped aperture 852 extended downwardly from V-shaped groove 851 being in communication with inlet channel 842 and inlet hole 74.

Referring to FIG. 2 specifically, in blowing operation, yarn is first placed on V-shaped groove 851. Then move sliding block 84 toward seat 80 with riser 841 inserted into opening 81 for being adjacent to the raised member 831. Next pivot the trigger member 83 to cause the raised member 831 to be disposed vertically. Hence, the raised member 831 may block a further movement of riser 841. Thus, the sliding block 84 is confined in U-shaped opening 701 without sliding out of U-shaped opening 701. Also, suitably move the sliding block 84 to cause aperture 852 to align with inlet channel 842 and inlet hole 74. Further, stop member 78 is disposed on V-shaped groove 851. Hence, external high pressure air is directed through inlet hole 74, inlet channel 842, and aperture 852 to blow onto yarn on V-shaped groove 851.

Referring to FIG. 3 specifically, in a further blowing operation or cleaning block member 85, user may simply pivot the trigger member 83 to cause raised member 831 to be disposed horizontally. Hence, raised member 831 may become disengaged from riser 841. Thus, the sliding block 84 is free to move externally (as indicated by arrow). Hence, V-shaped groove 851 is exposed. Moreover, it is possible to remove sliding block 84 from U-shaped opening 701. This completes the operation.

In brief, by pivoting the trigger member 83 to cause sliding block 84 to move and adjusting the position of stop member 78 by engagement member 77, the yarn blowing or cleaning operation is made much convenient as compared with prior art. Further, the constituent components are simplified. Thus, assembly is simple and manufacturing cost is reduced.

While the invention has been described by means of specific embodiments, numerous modifications and variations could be made thereto by those skilled in the art without departing from the scope and spirit of the invention set forth in the claims.

What is claimed is:

1. A nozzle for a knitting machine comprising:

a fastening block comprising a U-shaped opening and an inlet hole through said bottom in fluid communication with a high pressure air source;

a seat under said fastening block adjacent said U-shaped opening, said seat comprising an opening in communication with said U-shaped opening;

a trigger member pivotably disposed on both sides of said fastening block, said trigger member comprising a raised member in said opening of said seat; and a sliding block removably received in said U-shaped opening, said sliding block comprising a riser facing said seat, an inlet channel through said sliding block, a block member on said top of said inlet channel, a V-shaped groove on said block member, an aperture extended downwardly from said V-shaped groove being in communication with said inlet channel and said inlet hole.

2. The nozzle of claim 1, further comprising a recess on said same side as said inlet hole formed on said top of said fastening block, a pair of arms on both sides of said recess, an engagement member between said arms, a stop member between said engagement member and said inlet hole, a longitudinal hole through said engagement member in communication with said recess, an adjusting screw threadedly secured in said longitudinal hole, and a first elastic plate in said recess urged against said bottom of said adjusting screw for adjusting said position of said stop member.

3. The nozzle of claim 1 or 2, further comprising a groove on said top of said seat, a second elastic plate obliquely disposed in said groove wherein said raised member is disposed horizontally or vertically when pivoting said trigger member and one side of said trigger member is capable of fastening to said second elastic plate.

4. The nozzle of claim 1, wherein said block member is formed of ceramic material.

5. The nozzle of claim 2, wherein said stop member is formed of ceramic material.

* * * * *